US006309191B1

(12) United States Patent
Hu

(10) Patent No.: US 6,309,191 B1
(45) Date of Patent: Oct. 30, 2001

(54) BRUSHLESS FAN

(75) Inventor: Chin Yi Hu, Taipei (TW)

(73) Assignee: Tranyoung Technology Corp., Taipei (TW)

( * ) Notice: Subject to any disclaimer, the term of this patent is extended or adjusted under 35 U.S.C. 154(b) by 0 days.

(21) Appl. No.: 09/565,411

(22) Filed: May 4, 2000

(51) Int. Cl.[7] ..... F04B 17/00
(52) U.S. Cl. ..... 417/423.12
(58) Field of Search ..... 417/423.1, 423.12, 417/423.7, 354

(56) References Cited

U.S. PATENT DOCUMENTS 4,861,237 * 8/1989 Shiraki et al. ..... 417/353
5,997,265 * 12/1999 Chung ..... 417/423.13
6,050,785 * 4/2000 Horng ..... 417/354
6,183,221 * 2/2001 Hsieh ..... 417/423.012

* cited by examiner

*Primary Examiner*—Charles G. Freay
*Assistant Examiner*—William H Rodriguez
(74) *Attorney, Agent, or Firm*—Pro-Techtor International Services

(57) ABSTRACT

A brushless fan comprises a rotor assembly, a stator assembly, a frame, a retaining ring, and an oil ring. Concentric inner and outer slopes are provided at bottom of shaft housing for supporting bearing and stator assembly. As such, bearing and stator assembly precisely position with respect to shaft housing for obtaining an optimum magnetization, whereby shaft can stably rotate under the influence of magnetic field of rotor. Lubricating oil reservoir is provided between bearing and the top of shaft housing. Oil ring and projected cylindrical member are provided on top of shaft housing being oblique with respect to each other and separated by a minimum gap, thereby sealing the oil reservoir. With this, lubricating oil is prevented from spilling when rotor is rotating. Further a larger oil storage space and the omission of washer are effected.

14 Claims, 3 Drawing Sheets

BRUSHLESS FAN

FIELD OF THE INVENTION

The present invention relates to the art fan and more particularly to a direct-current brushless fan with improved features.

BACKGROUND OF THE INVENTION

The manufacturing techniques of direct-current brushless motor and fan are well-known. Direct-current brushless fan are widely employed in a variety of fields particularly as cooling fan due to low power consumption, low noise, and durability. As such, effort to maintain and further improve such advantages is still desirable.

Conventionally, the smoothness of direct-current brushless motor in rotation is adjusted by manufacturing worker. However, most workers just perform required operations in assembling the work without a sufficient experience to install rotor in a position with respect to stator for obtaining an optimum magnetization. As such, fan may not operate smoothly due to slantingly configured components. A few manufacturers have noticed such problem. However, no document has disclosed techniques to easily assemble rotor and stator in above optimum position.

A conventional technique aiming at eliminating above problem is disclosed. It places washer in shaft housing to adjust the position of rotor with respect to stator. However, the previous design suffered from several disadvantages: 1) Friction may increase due to the insertion of washer which in turn generates noise. An improvement is to fill lubricating oil into shaft housing to reduce friction. But the volumn of oil reservoir is thus decreased. Further, lubricating oil may spill out of shaft housing in operation: 2) Retaining ring is usually employed to secure the end of shaft. Accordingly, retaining ring may rotate when shaft rotates. As such, high friction resistance must exist between retaining ring and shaft in rotation which in turn adversely affects the smoothness of rotation as well as generates noise. Moreover, a rotational resistance to fan still exists in the oil reservoir due to the rotation of retaining ring.

Thus, it is desirable to provide a brushless fan in order to overcome the above drawbacks of prior art.

SUMMARY OF THE INVENTION

It is an object of the present invention to provide a brushless fan having the features of smooth rotation, stability, no slanting configured component, very low noise, and excellent lubrication.

It is another object of the present invention to provide a brushless fan having a larger lubricating oil storage space and without the provision of washer.

To achieve the above and other objects, the present invention provides a brushless comprising a variety of features. In detail, within the shaft housing, a first slope near bottom is tapered toward the bottom of shaft housing for supporting bearing. At the external surface, a second slope is tapered from above the bottom of base toward shaft housing for supporting stator assembly. As such, bearing and stator assembly can precisely position with respect to shaft housing for obtaining an optimum magnetization, whereby shaft is able to stably rotate under the influence of magnetic field of rotor. Lubricating oil reservoir is provided between bearing and the top of shaft housing. Oil ring and projected cylindrical member are provided on top of shaft housing being oblique with respect to each other and separated by a minimum gap, thereby sealing the oil reservoir. With this minimum gap, lubricating oil is effectively prevented from spilling when cylindrical housing is rotating. Further, a larger oil storage space and the omission of washer are effected. Finally, retaining ring is secured to the bottom of shaft housing. Outer diameter of retaining ring conforms to inner diameter of shaft housing, while inner diameter of retaining ring is slightly larger than outer diameter of groove of shaft. With this, retaining ring may not rotate when shaft rotates. Thus no frictional resistance exists between friction and other element and in lubricating oil. Also, a very low noise is generated. Most importantly, the performance of fan is improved.

The above and other objects, features and advantages of the present invention will become apparent from the following detailed description taken with the accompanying drawings.

DETAILED DESCRIPTION OF THE PREFERRED EMBODIMENTS

Figure 1:
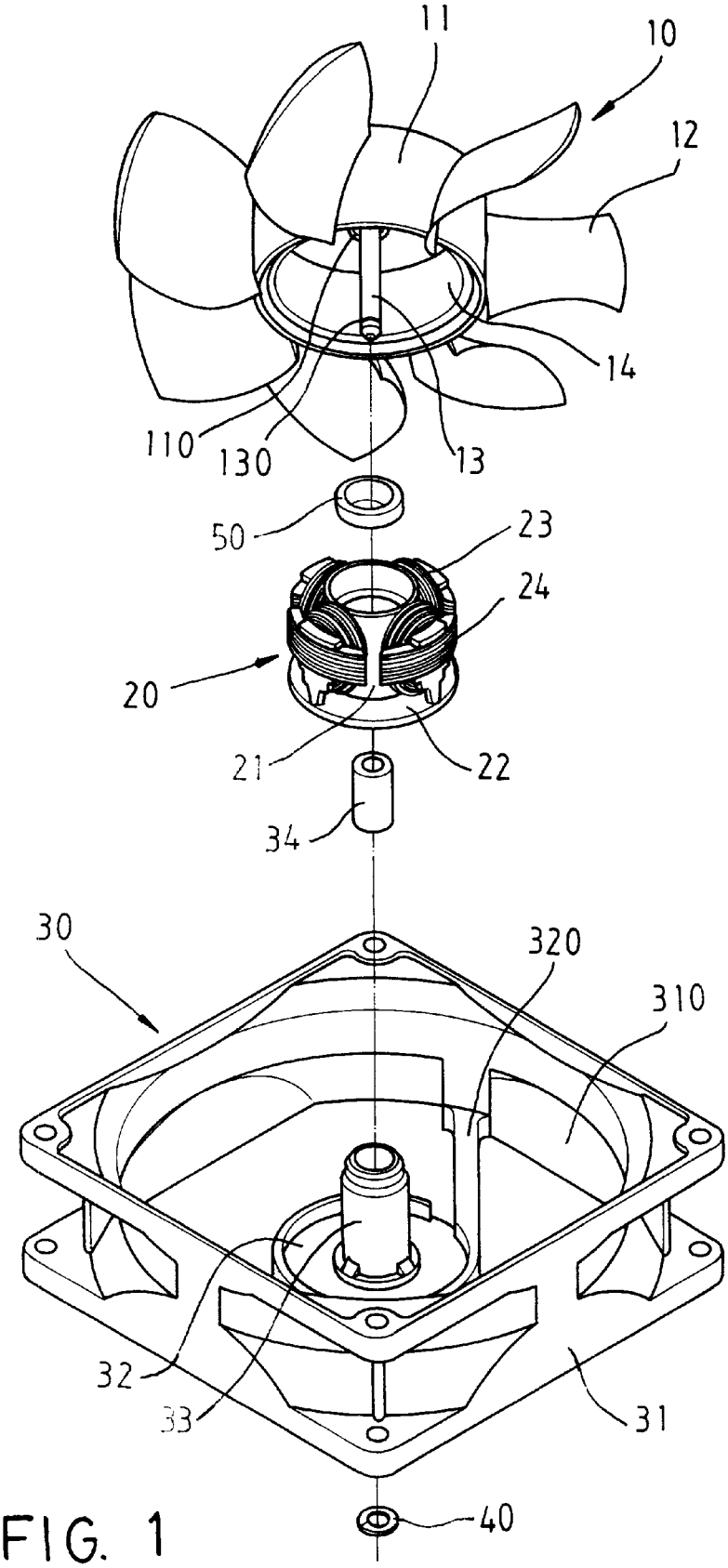
FIG. 1 is an exploded view of a brushless fan of an embodiment according to the invention.

Referring to FIG. 1, there is shown a brushless fan constructed in accordance with the invention comprising a rotor assembly 10, a stator assembly 20, a frame 30, a retaining ring 40, and an oil ring 50. A detail description of each component is as below.

Rotor assembly 10 includes a cylindrical housing 11 with an open bottom, a plurality of blades 12 equally provided along the circumferential outer surface of cylindrical housing 11, a central shaft 13 secured to the top of cylindrical housing 11 having an annular groove 130 near the bottom end, and a magnet frame 14 made of permanent magnet fixed to the circumferential inner surface of cylindrical housing 11.

Stator assembly 20 includes a tube member 21, a circuit board 22 formed as an annular flange in the bottom of tube member 21, a winding 23 provided on the outer surface of tube member 21, and a silicon steel plate 24 attached to the winding 23 wherein a sufficient magnetic field is generated along tube member 21 when circuit board 22 is electrically connected to a power source.

Frame 30 includes a parallelepiped body 31 defining a space 310 for receiving and allowing rotor assembly 10 to rotate therein, a central base 32 supported by a plurality of brackets 320 attached between body 31 and base 32, a tubelike shaft housing 33, and a bearing 34 fitted tightly in shaft housing 33 for receiving shaft 13 therethrough. A retaining ring 40 fits in groove 130.

Figure 4:
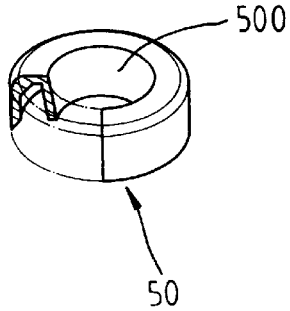
FIG. 4 is a perspective view of oil ring of FIG. 1 with a portion cut away to reveal the section features.
Figure 2:
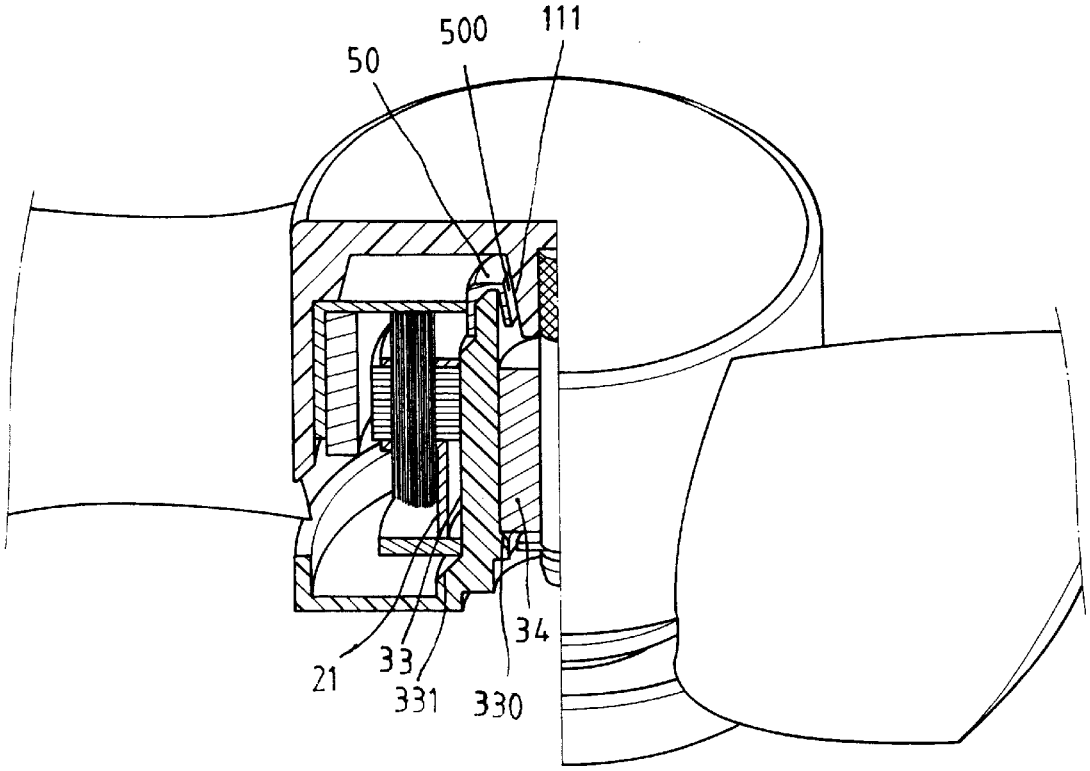
FIG. 2 is a partial perspective view of the assembled brushless fan of FIG. 1 with a portion cut away to reveal the interior features.
Figure 3:
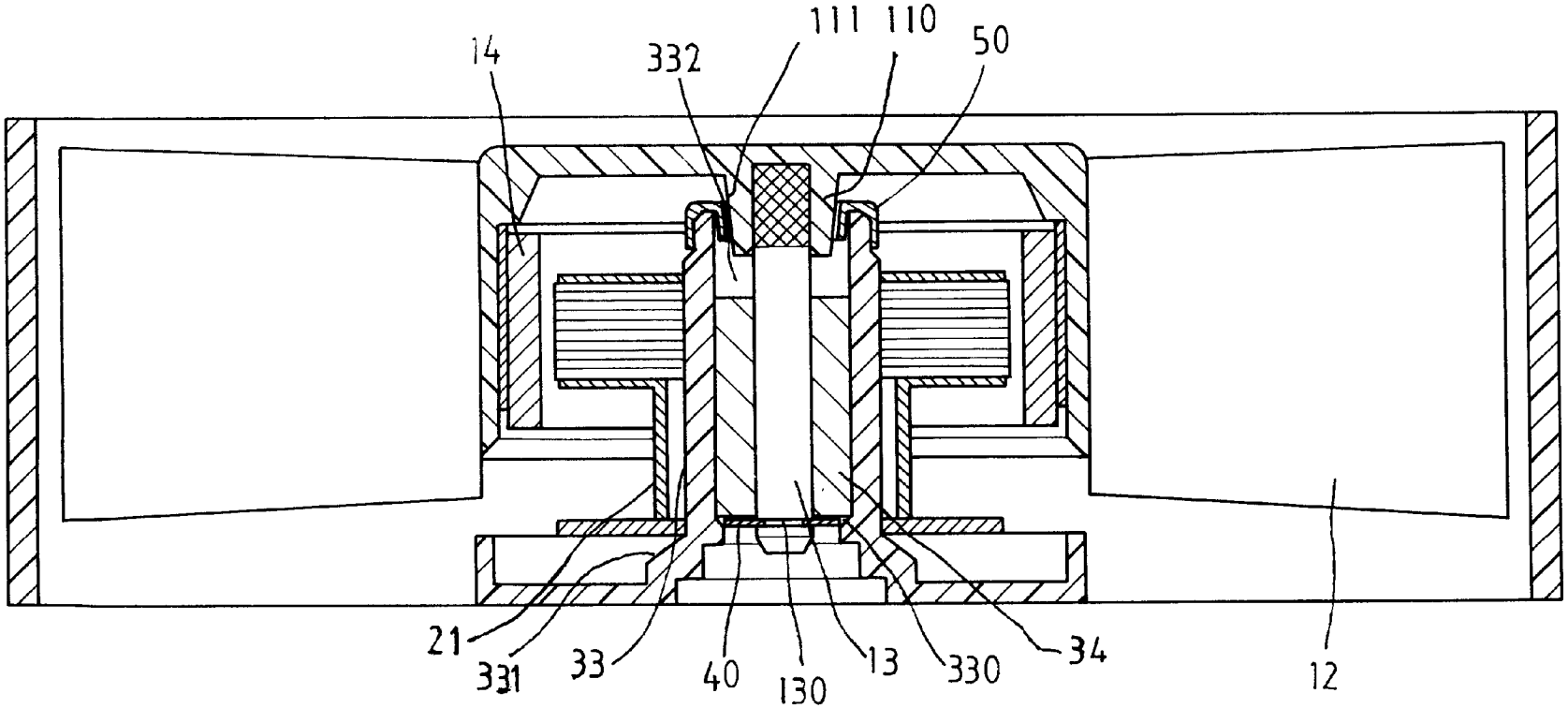
FIG. 3 is a sectional view of brushless fan of FIG. 1.

FIGS. 2, 3, and 4 illustrate the features of the invention. Within the shaft housing 33, a first slope 330 near bottom is tapered toward the bottom of shaft housing 33 for supporting bearing 34. At the external surface, a second slope 331 is tapered from above the bottom of base 32 toward shaft housing 33 for supporting stator assembly 20. First and second slopes 330 and 331 are concentric. As such, bearing 34 and stator assembly 20 can precisely position with respect to shaft housing 33 for obtaining an optimum magnetization, whereby shaft 13 pivotably provided in bearing 34 is able to stably rotate under the influence of magnetic field of rotor assembly 10. A lubricating oil reservoir 332 is provided between the top bearing 34 and the top of shaft housing 33. A cylindrical oil ring 50 is provided on top of shaft housing 33 (FIG. 4) for preventing lubricating oil in reservoir 332 from spilling. A projected cylindrical member 110 is provided at the bottom of the top surface of cylindrical housing 11 for receiving the upper portion of shaft 13. Oil ring 50 and projected cylindrical member 110 are oblique with respect to each other, thereby forming a third slope 500 and a fourth slope 111 respectively. These two slopes 500 and 111 are tapered toward the bottom. Also, slopes 500 and 111 are separated by a predetermined minimum gap (e.g., about 0.1 cm). With such gap, lubricating oil is effectively prevented from spilling when cylindrical housing 11 is rotating. Preferably, lubricating oil has a satisfactory high viscosity. Further, with the configuration of slopes 500 and 111, even lubricating oil spilled to third slope 500 in rotation will return to oil reservoir 332 when fan stops rotating. This also has the benefits of providing a larger oil storage space as well as without the provision of washer.

Moreover, retaining ring 40 is secured to the bottom of shaft housing 33. Outer diameter of retaining ring 40 conforms to inner diameter of shaft housing 33, while inner diameter of retaining ring 40 is slightly larger than outer diameter of groove 130 of shaft 13. With this arrangement, retaining ring 40 may not rotate when shaft 13 rotates. Thus no frictional resistance exists between friction 40 and other element (e.g., bearing 34) and in lubricating oil. Also, a very low noise is generated. Most importantly, the performance of fan is improved. Note that second slope 331 are spaced provided at the bottom along the outer surface of shaft housing 33. It is appreciated that second slope 331 may be continuous, i.e., an annular shape in other embodiment.

While the invention herein disclosed has been described by means of specific embodiments, numerous modifications and variations could be made thereto by those skilled in the art without departing from the scope and spirit of the invention set forth in the claims.

What is claimed is:

1. A brushless fan comprising:

a rotor assembly including a cylindrical housing with an open bottom, a plurality of blades equally provided along the circumferential outer surface of the cylindrical housing, a central shaft secured to the top of the cylindrical housing having an annular groove at the bottom end, and a magnet frame fixed to the circumferential inner surface of the cylindrical housing;

a stator assembly; and a frame including a space for receiving the rotor assembly, a central base, a tubelike shaft housing, and a bearing fitted in the shaft housing for receiving the shaft therethrough;

wherein a first supporting member and a second supporting member are provided at the interior and the exterior abutted the bottom of the shaft housing for supporting the bearing and the stator assembly respectively such that the bearing and the stator assembly precisely position with respect to the shaft housing for obtaining an optimum magnetization, whereby the shaft can stably rotate under the influence of the magnetic field of the rotor assembly.

2. The brush less fan of claim 1, wherein the first and second supporting members are slopes.

3. The brushless fan of claim 2, wherein the first supporting member is tapered toward the bottom of the shaft housing.

4. The brushless fan of claim 2, wherein the second supporting member is tapered toward the shaft housing.

5. The brushless fan of claim 2, wherein the first and second supporting members are concentric.

6. The brushless fan of claim 1, wherein the second supporting member includes a plurality of sub-members spaced apart along the outer surface of the shaft housing.

7. The brushless fan of claim 1, wherein the second supporting member is an integral annular member provided along the outer surface of the shaft housing.

8. The brushless fan of claim 1, further comprising:

a lubricating oil reservoir provided between the bearing and the top of the shaft housing;

a sealing member provided on the top of shaft housing; and a projected cylindrical member provided at the bottom of the top surface of the cylindrical housing being oblique with respect to the sealing member.

9. The brushless fan of claim 8, wherein the sealing member is a ring.

10. The brushless fan of claim 8, further comprising a first tapered surface and a second tapered surface formed on the sealing member and the projected cylindrical member respectively wherein the first and second tapered surfaces are tapered toward the bottom.

11. The brushless fan of claim 10, further comprising a gap formed between the first and second tapered surfaces.

12. The brushless fan of claim 11, wherein the gap is about 0.1 cm.

13. The brushless fan of claim 1, further comprising a retaining ring fitted in the groove of the shaft and secured to the bottom of the shaft housing.

14. The brushless fan of claim 13, wherein the outer diameter of the retaining ring conforms to the inner diameter of the shaft housing and the inner diameter of the retaining ring is larger than the outer diameter of the groove of the shaft such that the retaining ring does not rotate when the shaft rotates.

* * * * *